US006745895B2

(12) United States Patent
Silvers

(10) Patent No.: US 6,745,895 B2
(45) Date of Patent: Jun. 8, 2004

(54) DIAPER CADDY

(76) Inventor: Brian Silvers, 1760 Fox Field Dr., Belvidere, IL (US) 61008

( * ) Notice: Subject to any disclaimer, the term of this patent is extended or adjusted under 35 U.S.C. 154(b) by 0 days.

(21) Appl. No.: 09/872,113

(22) Filed: Jun. 1, 2001

(65) Prior Publication Data

US 2002/0179462 A1 Dec. 5, 2002

(51) Int. Cl.[7] ..... B65D 71/00; B65D 1/36

(52) U.S. Cl. ..... 206/233; 206/570; 206/505; 206/494; 206/581; 206/564

(58) Field of Search ..... 206/233, 581, 206/37–38, 210, 561, 564, 494; 220/505, 570, 507, 500, 759

(56) References Cited

U.S. PATENT DOCUMENTS

| | | | | | |
|---|---|---|---|---|---|
| D142,366 | S | * | 9/1945 | Bourdius | D3/308 |
| 3,887,103 | A | * | 6/1975 | Spooner | 220/555 |
| D285,906 | S | | 9/1986 | Tyler | D9/425 |
| 4,685,559 | A | | 8/1987 | Titus | 206/38 |
| 4,706,845 | A | | 11/1987 | Schnurer et al. | 221/102 |
| 4,720,021 | A | * | 1/1988 | Byrns | 220/764 |
| 4,792,024 | A | * | 12/1988 | Morton et al. | 190/1 |
| D310,748 | S | | 9/1990 | Embree et al. | D34/40 |
| 4,961,522 | A | | 10/1990 | Weber | 224/151 |
| D314,279 | S | | 2/1991 | Hotchkiss | D3/30.1 |
| 5,036,997 | A | | 8/1991 | May et al. | 220/335 |
| 5,117,979 | A | | 6/1992 | Brightbill | 206/372 |
| D329,135 | S | | 9/1992 | Embree | D3/30.1 |
| D330,161 | S | | 10/1992 | Schuh | D9/423 |
| 5,230,450 | A | * | 7/1993 | Mahvi et al. | 190/108 |
| D341,027 | S | * | 11/1993 | Godden et al. | D3/274 |
| 5,370,263 | A | * | 12/1994 | Brown | 220/751 |
| D357,119 | S | * | 4/1995 | Calmeise et al. | D3/308 |
| 5,421,459 | A | * | 6/1995 | Mazzotti | 206/549 |
| 5,433,373 | A | | 7/1995 | Zoeller | 229/117.26 |
| 5,443,161 | A | | 8/1995 | Jonese | 206/581 |
| D367,172 | S | | 2/1996 | Brightbill et al. | D3/310 |
| D367,609 | S | | 3/1996 | Frank et al. | D9/425 |
| D371,030 | S | | 6/1996 | Hall | D6/515 |
| 5,624,095 | A | | 4/1997 | Zissu | 248/231.81 |
| 5,638,957 | A | | 6/1997 | Brasier | 206/581 |
| 5,655,680 | A | | 8/1997 | Asbach et al. | 220/404 |
| 5,678,727 | A | | 10/1997 | Rice | 221/98 |
| 5,702,140 | A | * | 12/1997 | Radja | 294/146 |
| 5,706,950 | A | | 1/1998 | Houghton et al. | 206/581 |
| D412,439 | S | | 8/1999 | Cormack | D9/425 |
| 6,182,022 | B1 | | 1/2001 | Mayle et al. | 702/182 |
| 6,213,304 | B1 | * | 4/2001 | Juliussen | 206/581 |
| 6,298,993 | B1 | * | 10/2001 | Kalozdi | 150/106 |

* cited by examiner

*Primary Examiner*—Jila M. Mohandesi
(74) *Attorney, Agent, or Firm*—Leydig, Voit & Mayer, Ltd.

(57) ABSTRACT

An apparatus for assisting in the changing of diapers for a baby in the form of a portable diaper caddy. The tray has a base adapted to rest upon a surface. The tray includes multiple selectively sized compartments including a diaper compartment in the tray adapted to contain a plurality of diapers, a pad compartment in the tray adapted to contain a baby changing pad, and a wipe compartment in the tray adapted to contain a plurality of wet baby wipes. A lid covers the wipe compartment, the lid sealing against a top portion of the wipe compartment to prevent evaporation of liquid contained in the wet baby wipes. A handle extends from the tray to allow persons to grasp the tray for carrying the tray.

24 Claims, 6 Drawing Sheets

DIAPER CADDY

FIELD OF THE INVENTION

The present invention relates generally to trays, and more particularly relates to portable trays for baby products.

BACKGROUND OF THE INVENTION

Parents change the diapers of babies frequently and often several times per day. In will readily be appreciated by parents everywhere that changing the diapers of babies is a difficult task. Many parents have been frustrated by the absence of any good products on the market for assisting parents in the diaper changing task in a convenient manner.

BRIEF SUMMARY OF THE INVENTION

The present invention is directed toward an apparatus for assisting in the changing of diapers for a baby in the form of a portable diaper caddy. The caddy includes tray having a base adapted to rest upon a surface. The tray includes multiple selectively sized compartments including a diaper compartment in the tray adapted to contain a plurality of diapers, a pad compartment in the tray adapted to contain a baby changing pad, and a wipe compartment in the tray adapted to contain a plurality of wet baby wipes. A lid covers the wipe compartment, the lid sealing against a top portion of the wipe compartment to prevent evaporation of liquid contained in the wet baby wipes. A handle extends from the tray to allow persons to grasp the tray for carrying the tray.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
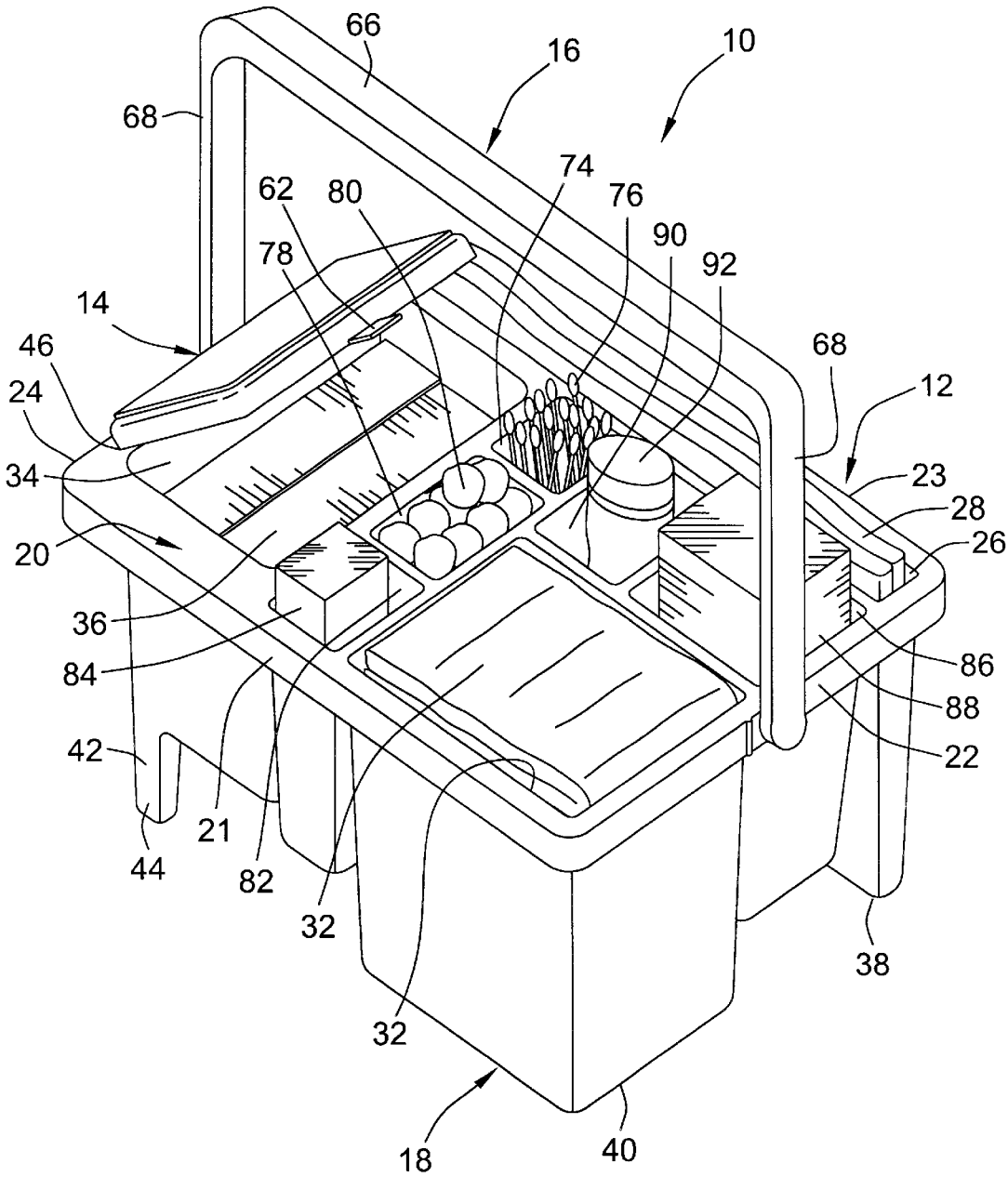
FIG. 1 is an isometric view of a portable diaper caddy holding a variety of diaper changing products, according to a preferred embodiment of the present invention.
Figure 2:
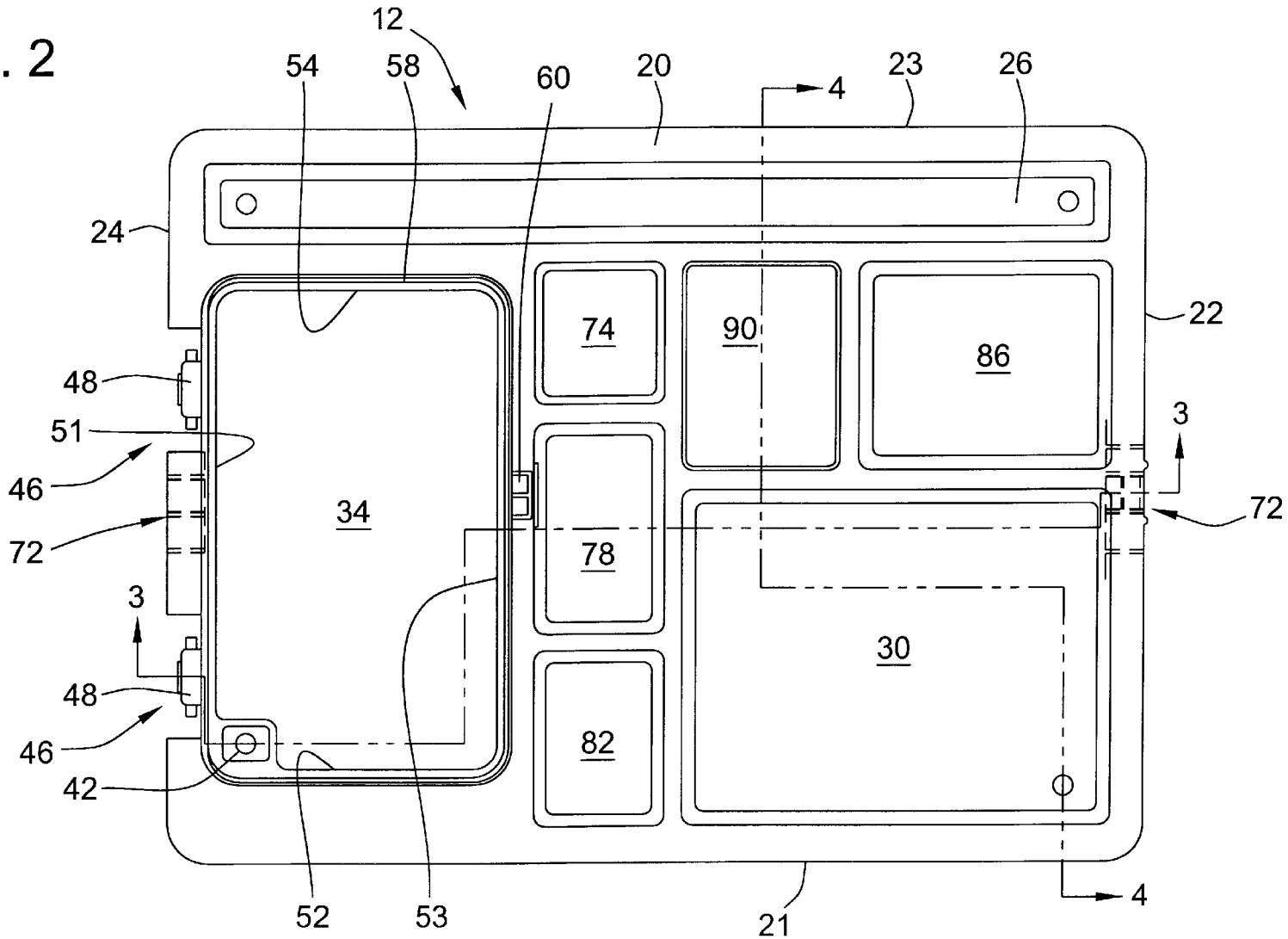
FIG. 2 is a top plan view of the tray part of the portable diaper caddy illustrated in FIG. 1.
Figure 3:
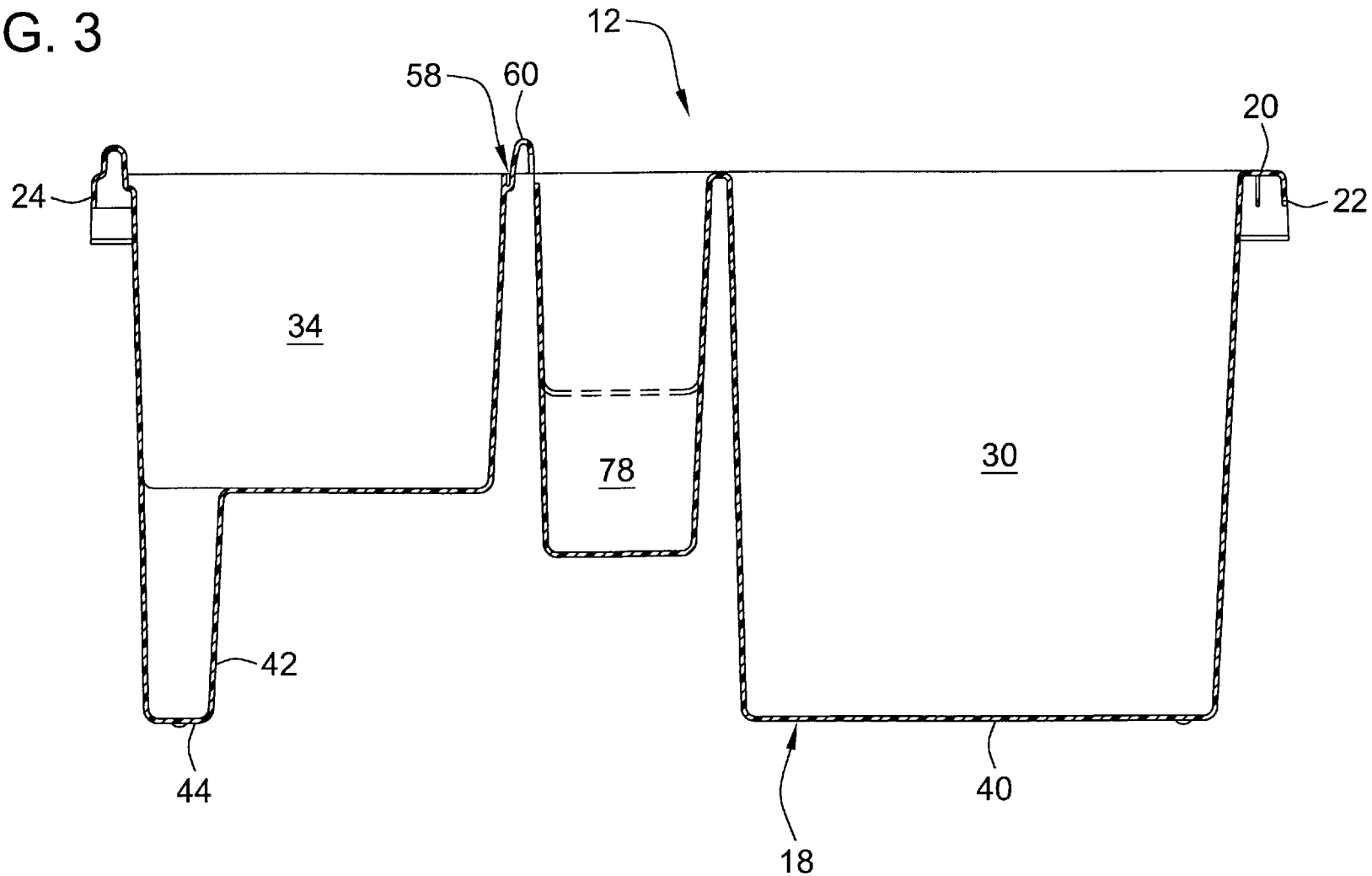
FIG. 3 is a cross section of FIG. 2 taken about line 3—3.
Figure 4:
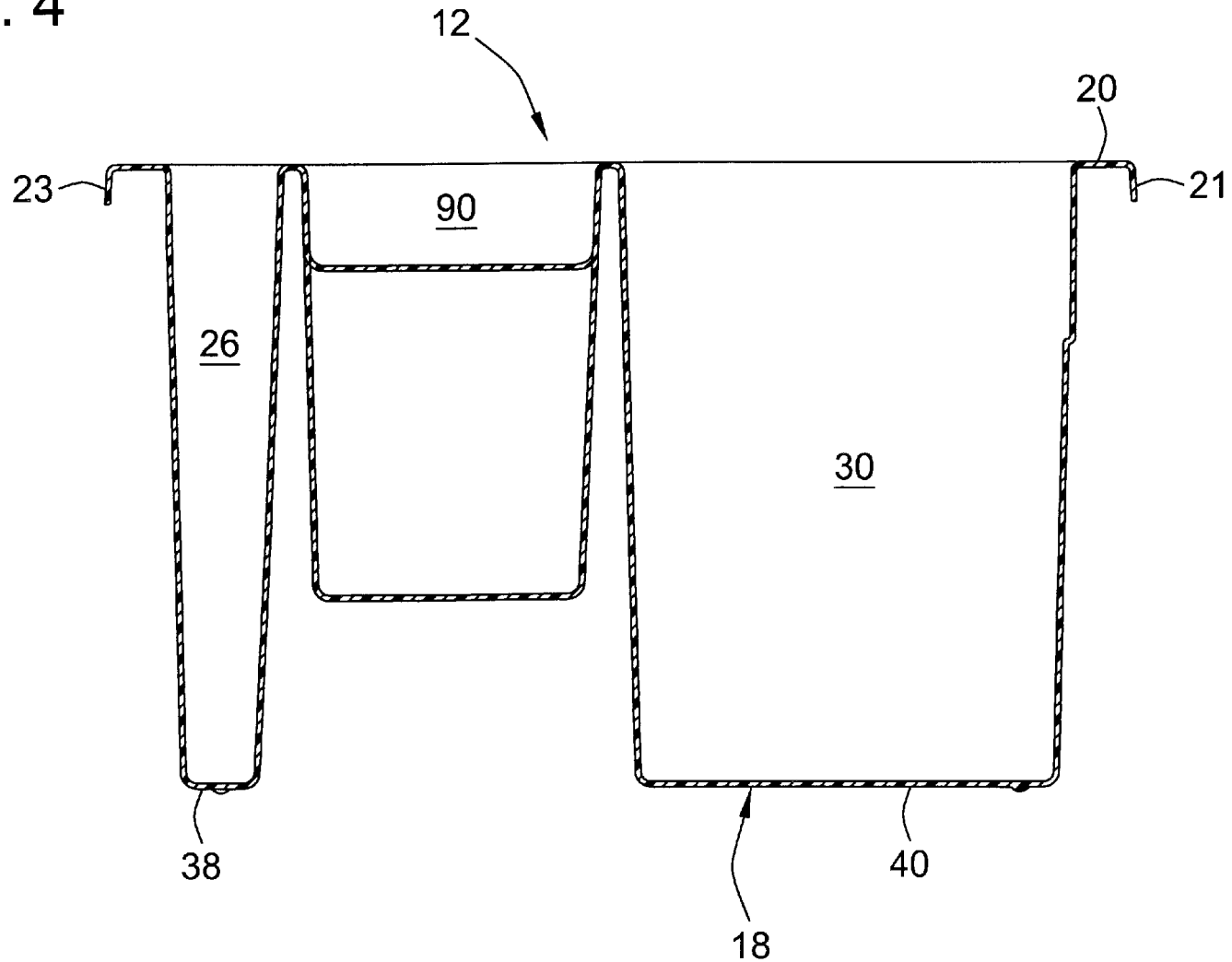
FIG. 4 is a cross section of FIG. 2 taken about line 4—4.
Figure 7:
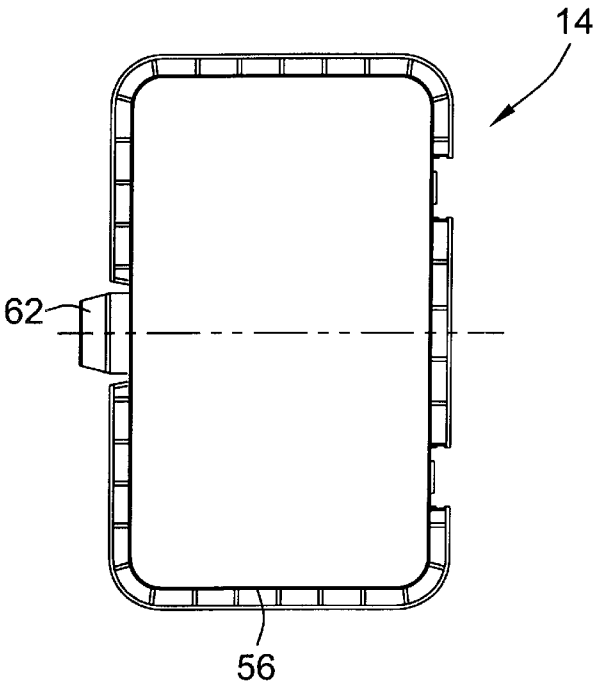
FIG. 7 is a bottom view of FIG. 5.
Figure 5:
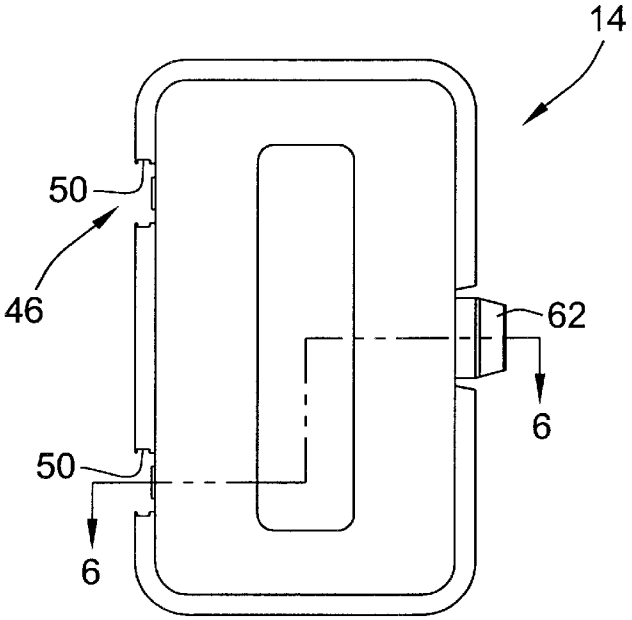
FIG. 5 is top plan view of the lid part of the portable diaper caddy illustrated in FIG. 1.
Figure 6:
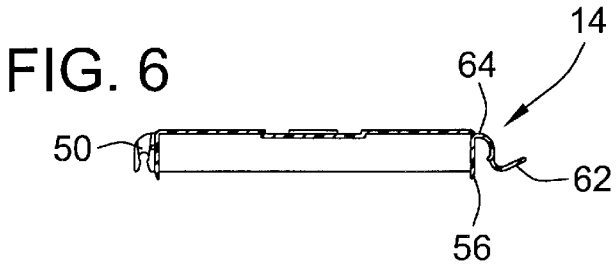
FIG. 6 is a cross section of FIG. 5 taken about line 6—6.
Figure 8:
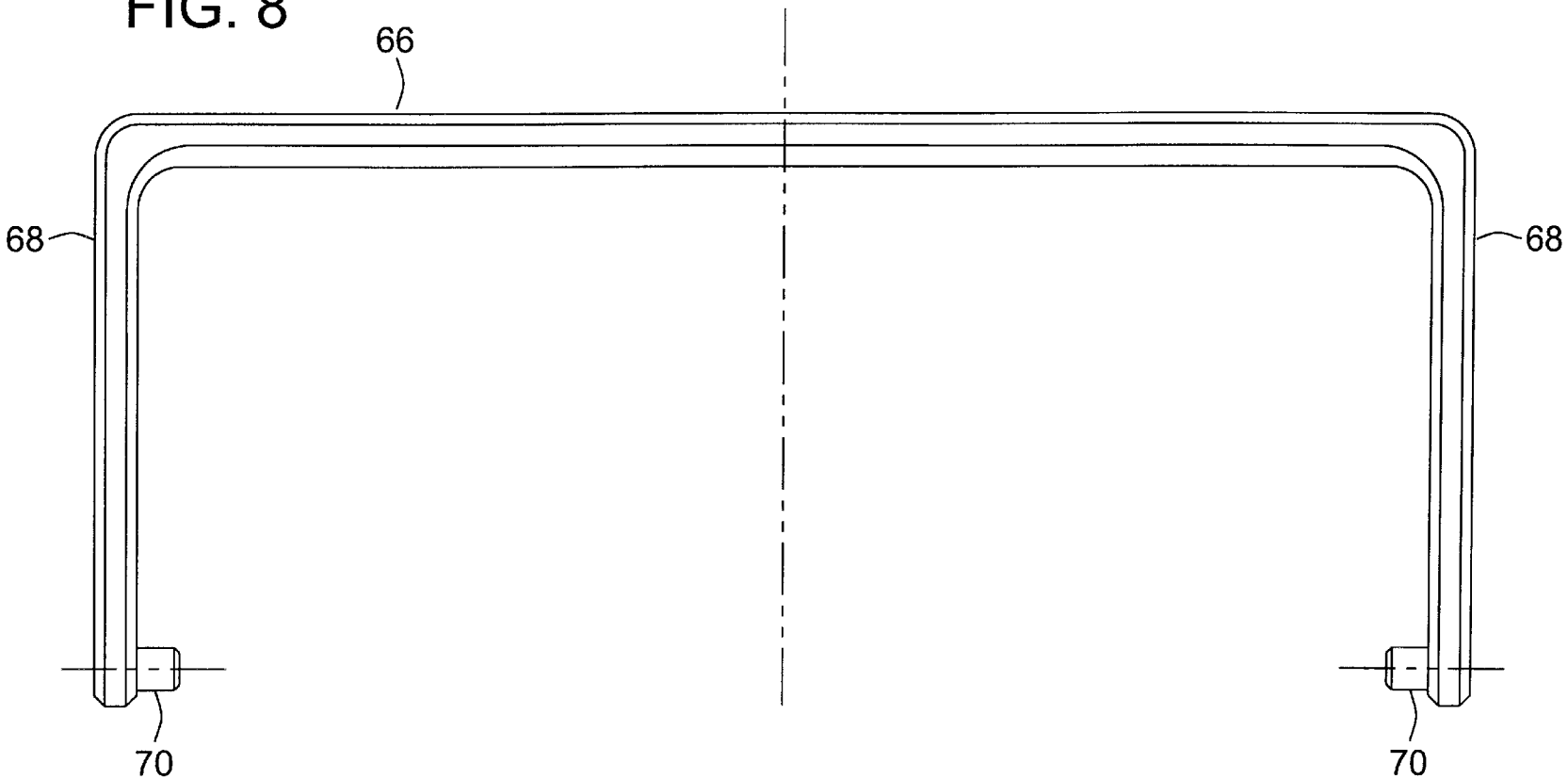
FIG. 8 is a side view of the snap in handle part of the portable diaper caddy illustrated in FIG. 1.

For purposes of illustration, a preferred embodiment of the present invention has been illustrated in FIG. 1 as a portable diaper caddy 10. In the disclosed embodiment, the caddy 10 is assembled from three separate parts including a unitary plastic tray 12 as shown in FIGS. 2–4, a plastic lid 14 as shown in FIGS. 5–7, and a handle 16 as shown in FIG. 8. The diaper caddy 10 can be easily transported from place to place, set down on a surface close to where the baby diaper changing operations are to take place, carrying all of the supplies necessary to change diapers, with quick access to the contents of the tray 12 to make the process of changing diapers easier and more convenient.

The tray 12 extends vertically between a generally flat base 18 and a top surface 20. The tray base 18 is adapted to lie flat on a support surface provided by a table, the ground or other suitable support. As illustrated in FIGS. 1 and 2, the tray 12 is generally rectangular. For purposes of reference, the tray 12 comprises first, second, third and fourth sides 21, 22, 23, 24. The first and third sides 21, 23 extend parallel. Similarly, the second and fourth side 22, 23 extend parallel.

A plurality of primary purpose compartments extend vertically into the top surface 20 of the tray 12 to hold the necessary items for completing a diaper change. In particular, the tray 12 includes an elongated pad compartment 26 containing a flexible folded up baby pad 28, a diaper compartment 30 containing a plurality of diapers 32, and a wipe compartment 34 containing a plurality of wet baby wipes 36.

The pad compartment 26 extends along the entire length of the third side 23 transversely between the second and fourth sides 22, 24. The pad compartment 26 extends vertical downward to a bottom surface 38 coplanar with and forming a part of the tray base 18 for supporting the tray 12 upright. The pad 28 can be removed from the pad compartment 26, then unfolded and placed on a surface to provide a clean and comfortable surface upon which to place the baby for the diaper change. The pad 28 is refolded and returned to the pad compartment 26 when the diaper change is completed.

The diaper compartment 30 is adjacent the first and second sides 21, 22 and also extends down to a bottom surface 40 that is coplanar and forms a portion of the tray base 18 for upright support of the tray 12. The diaper compartment 30 is adjacent the first and the second sides 21, 22, in a corner therebetween. The diaper compartment 30 is closely dimensioned to the largest commercial available diaper, and holds multiple diapers 32, and holds a package of diapers or between 10 and 25 diapers 32 substantially flush with the tray.

The wipe compartment 34 is adjacent the first and fourth sides 21, 24. but does not extend to the base 18. To prevent the caddie 10 from upsetting, a vertically extending leg 42 is formed into a corner between the first and fourth sides 21, 24. The leg 42 is spaced in relation to the other bottom surfaces 38, 40 and forms a third bottom surface 44 coplanar with and forming a portion of the tray base 18. The three bottom surfaces 38, 40, 44 allow the tray 12 to stand in a sturdy upright position. The wipe compartment 34 holds multiple wet baby wipes 36 (e.g. between 20 and 80 wipes). The wet baby wipes 36 typically include a water and/or alcohol based cleaning solution.

The lid 14 covers the wipe compartment 34 and seals against the tray 12 to prevent evaporation of liquid contained in the wet baby wipes 36. In the disclosed embodiment, the lid 14 is connected to the base via a hinge 46 formed by interfitting structures 48, 50 on the tray 12 and lid 14. The hinge 46 allows the lid 14 to be pivoted upwardly to open the wipe compartment 34 and downwardly to close the wipe compartment 34. For purposes of reference, the wipe compartment 34 is rectangular including first, second, third, and fourth sidewalls 51, 52, 53, 54. The lid 14 is hinged to the first sidewall 51. To prevent liquid evaporation from the wet baby wipes, the disclosed embodiment includes a tongue and groove seal between the lid 14 comprising a vertically extending tongue 56 extending all of the way around the rectangular periphery of the lid 14 and a receiving groove 58 extending around the tops ends of at least the second, third and fourth sidewalls 52, 53, 54. The tongue 56 is received in and engages the walls of the groove 58 to provide a seal. Because it would be difficult for the tongue 56 to pivot into a groove at the top of the first side wall 51, the tongue 56 horizontally deflects in engagement with the first side wall 51 to provide a seal along the first side wall 51.

A resilient snap connection keeps the lid 14 sealed to the tray 12. In the disclosed embodiment, the snap connection comprises a flexible hook 60 extending freely from the top surface 20 of the tray 12 and a lift tab 62 projecting horizontally from the lid 14. When the lid 14 is being pivoted and closed, the hook 60 deflects past a rib 64 on the tab 62 and then expands horizontally after clear the rib 64 to latch on the tab 62. The engagement between the tab 62 and the hook 60 keep the lid 14 closed and the tongue 56 and groove 56 in engagement to provide a seal. When it is desired to pivot the lid 14 open to access baby wipes, the hook 60 can be manual deflected to obviate the rib 64 and simultaneously the lift tab 62 is lifted by a finger to open the wipe compartment 34.

The handle 16 comprises a horizontal gripping bar 66 integrally formed with a pair of perpendicular arms 68. Each arm 68 includes an cylindrical pivot projection 70 that snaps into cylindrical cavities 72 on the second and fourth sides 22, 24 of the tray 12. The handle 16 can be pivoted to a vertical position for carrying and downward to a horizontal position to prevent interference with the tray compartments.

The tray 12 further preferably includes multiple accessory compartments. The disclosed embodiment includes a swab compartment 74 containing a plurality of cotton swabs 76, a cotton ball compartment 78 containing a plurality of cotton balls 80, an ointment compartment 82 containing a vessel of ointment 84, a powder compartment 86 containing a vessel of baby powder 88, and a miscellaneous compartment 90 for any other necessary items. The accessory compartments 74, 78, 82, 86, 90 are shallow and do not extend very deep to allow easy access to the contents contained therein. As shown, these compartments are arranged between the pad compartment 26, the diaper compartment 30 and the wipe compartment 34 (and the leg 42) to allow a wider support base 18 for the tray 12. It will be appreciated that the number of accessory compartments can be adjusted without departing from the scope of the invention. For example the central three compartments 74, 78, 82 could be eliminated and replaced instead with a fixed handle integrally formed with the tray 12.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus adapted to rest upon a surface for assisting in the changing of diapers for a baby, comprising:

a tray having a base adapted to rest upon the surface, the tray vertically extending from the base to a tray top;

a diaper compartment formed into the tray top and extending vertically downward, the diaper compartment containing a plurality of diapers;

a pad compartment formed into the tray top and extending vertically downward, the pad compartment containing a baby changing pad;

a wipe compartment formed into the tray top and extending vertically downward, the wipe compartment containing a plurality of wet baby wipes;

a lid removably covering the wipe compartment, the lid sealing against a top portion of the wipe compartment to prevent evaporation of liquid contained in the wet baby wipes; and a handle extending from the tray adapted to be grasped for supporting and carrying the tray.

2. The apparatus of claim 1 wherein the tray is rectangular comprising first, second, third and fourth sides, the first and third sides extending parallel and the second and fourth sides extending parallel.

3. The apparatus of claim 2 wherein the pad compartment extends along the third side transversely between the second and fourth sides, and wherein the diaper compartment is adjacent the first and the second sides, and wherein the wipe compartment is adjacent the first and the fourth sides.

4. The apparatus of claim 3 wherein the diaper and pad compartments include first and second bottoms forming a portion of the base, the tray further comprising a leg in spaced relation to the first and second bottoms form a third bottom also forming a portion of the base, wherein the tray is supported on the surface by the first second and third bottoms.

5. The apparatus of claim 3 further comprising a plurality of accessory compartments with at least one accessory compartment between the pad compartment and the diaper compartment, and at least one accessory compartment between the diaper compartment and the wipe compartment, at least one of the accessory compartments containing at least one of the following baby care products selected from the group comprising: powder, swabs, cotton balls, and ointment.

6. The apparatus of claim 1 wherein the tray is a single unitary plastic molded component, and wherein the lid and handle are separately molded components.

7. The apparatus of claim 6 wherein the wipe compartment is rectangular including first, second, third, and fourth sidewalls, the lid being hinged to the first sidewall, further comprising a tongue and groove seal between the lid and the tray and a snap connection between the lid and the tray.

8. The apparatus of claim 7 wherein the tongue and groove seal comprises a groove formed into the tray at top edges of the second, third and fourth sidewalls, and a tongue extending around the lid in a rectangular path, the tongue engaging the groove when the lid is closed forming a seal, the tongue horizontally engaging the first side wall for sealing therebetween.

9. The apparatus of claim 6 wherein the lid is a separate part from the tray, wherein the lid is hinged to the tray for pivoting movement between open and closed positions, the tray comprising a flexible hook extending freely from the top surface of the tray, the lid including and a lift tab projecting horizontally from the lid in the closed position, the lift tab including a opening, the flexible hook deflecting through the opening and expanding to latch on the lift tab as the lid is pivoted from the open position to the closed position.

10. The apparatus of claim 6 wherein the handle is a separate part snapped into the tray at opposing ends of the tray, the handle pivoting upwardly for grasping and downwardly for allowing better access to the tray.

11. The apparatus of claim 1 wherein the lid is hinged to the tray for pivoting movement between open and closed positions, the tray comprising a flexible hook extending freely from the top surface of the tray, the lid including and a lift tab projecting horizontally from the lid in the closed position, the lift tab including a opening, the flexible hook deflecting through the opening and expanding to latch on the lift tab as the lid is pivoted from the open position to the closed position.

12. An apparatus adapted to rest upon a surface for assisting in the changing of diapers for a baby, the apparatus for holding a plurality of diapers, a baby changing pad, and a plurality of baby wipes, comprising:

a plastic tray having a base adapted to rest upon the surface, the tray vertically extending from the base to a tray top, the tray top having an outer peripheral rim extending vertically an surrounding the tray;

a rectangular diaper compartment formed into the tray top and extending vertically downward, the diaper compartment adapted to contain the plurality of diapers via gravity;

a rectangular pad compartment formed into the tray top and extending vertically downward, the pad compartment adapted to contain the baby changing pad via gravity;

a rectangular wipe compartment formed into the tray top and extending vertically downward, the wipe compartment adapted to contain the plurality of wet baby wipes via gravity;

a lid removably covering the wipe compartment, the lid sealing against a top portion of the wipe compartment for preventing evaporation of liquid contained in the wet baby wipes;

a handle extending from the tray adapted to be grasped for supporting and carrying the tray; and wherein the diaper and pad compartments include first and second bottoms forming a portion of the base, the tray further comprising a leg in spaced relation to the first and second bottoms form a third bottom also forming a portion of the base, wherein the tray is supported on the surface by the first second and third bottoms.

13. The apparatus of claim 12 wherein the pad compartment extends along the third side transversely between the second and fourth sides, and wherein the diaper compartment is adjacent the first and the second sides, and wherein the wipe compartment is adjacent the first and the fourth sides.

14. The apparatus of claim 13 further comprising a plurality of accessory compartments with at least one accessory compartment between the pad compartment and the diaper compartment, and at least one accessory compartment between the diaper compartment and the wipe compartment, at least one of the accessory compartments adapted to contain at least one of the following baby care products selected from the group comprising: powder, swabs, cotton balls, and ointment.

15. The apparatus of claim 12 wherein the tray is rectangular comprising first, second, third and fourth sides, the first and third sides extending parallel and the second and fourth sides extending parallel.

16. The apparatus of claim 12 wherein the tray is a single unitary plastic molded component, and wherein the lid is a separately molded component.

17. The apparatus of claim 16 wherein the lid and the handle are separate parts from the tray, the handle being snapped into the tray at opposing ends of the tray, the handle pivoting upwardly for grasping and downwardly for allowing better access to the tray.

18. An apparatus adapted to rest upon a surface for assisting in the changing of diapers for a baby, the apparatus for holding a plurality of diapers, a baby changing pad, and a plurality of baby wipes, comprising:

a plastic tray having a base adapted to rest upon the surface, the tray vertically extending from the base to a tray top, the tray top having an outer peripheral rim extending vertically and surrounding the tray;

a rectangular diaper compartment formed into the tray top and extending vertically downward, the diaper compartment adapted to contain the plurality of diapers via gravity;

a rectangular pad compartment formed into the tray top and extending vertically downward, the pad compartment adapted to contain the baby changing pad via gravity;

a rectangular wipe compartment formed into the tray top and extending vertically downward, the wipe compartment adapted to contain the plurality of wet baby wipes via gravity;

a lid removably covering the wipe compartment, the lid sealing against a top portion of the wipe compartment for preventing evaporation of liquid contained in the wet baby wipes;

a handle extending from the tray adapted to be grasped for supporting and carrying the tray; and wherein the wipe compartment is rectangular including first, second, third, and fourth sidewalls, the lid being hinged to the first sidewall, further comprising a tongue and groove seal between the lid and the tray and a snap connection between the lid and the tray.

19. The apparatus of claim 18 wherein the tongue and groove seal comprises a groove formed into the tray at top edges of the second, third and fourth sidewalls, and a tongue extending around the lid in a rectangular path, the tongue engaging the groove when the lid is closed forming a seal, the tongue horizontally engaging the first side wall for sealing therebetween.

20. An apparatus adapted to rest upon a surface for assisting in the changing of diapers for a baby, comprising:

a tray having a base adapted to rest upon the surface, the tray vertically extending from the base to a top, the tray being rectangular comprising first, second, third and fourth sides, the first and third sides extending parallel and the second and fourth sides extending parallel;

a diaper compartment formed into the tray top and extending vertically downward, the diaper compartment containing a plurality of diapers, the diaper compartment being adjacent the first and the second sides;

a pad compartment formed into the tray top and extending vertically downward, the pad compartment containing a baby changing pad the pad compartment extending along the third side transversely between the second and fourth sides;

a wipe compartment formed into the tray top and extending vertically downward, the wipe compartment containing a plurality of wet baby wipes, the wipe compartment being adjacent the first and the fourth sides;

a lid covering the wipe compartment, the lid sealing against a top portion of the wipe compartment to prevent evaporation of liquid contained in the wet baby wipes;

a handle extending from the tray adapted to be grasped for supporting and carrying the tray; a leg, wherein the diaper and pad compartments include first and second bottoms forming a portion of the base, the leg extending vertically in spaced relation to the first and second bottoms form a third bottom also forming a portion of the base, wherein the tray is supported on the surface by the first second and third bottoms;

a plurality of accessory compartments with at least one accessory compartment between the pad compartment and the diaper compartment, and at least one accessory compartment between the diaper compartment and the wipe compartment, at least one of the accessory compartments containing at least one of the following baby care products selected from the group comprising: powder, swabs, cotton balls, and ointment.

21. The apparatus of claim 20 wherein the tray is a single unitary plastic molded component, and wherein the lid is a separately molded component.

22. The apparatus of claim 21 wherein the wipe compartment is rectangular including first, second, third, and fourth sidewalls, the lid being hinged to the first sidewall, further comprising a tongue and groove seal between the lid and the tray and a snap connection between the lid and the tray.

23. The apparatus of claims 22 wherein the tongue and groove seal comprises a groove formed into the tray at top edges of the second, third and fourth sidewalls, and a tongue extending around the lid in a rectangular path, the tongue engaging the groove when the lid is closed forming a seal, the tongue horizontally engaging the first side wall for sealing therebetween.

24. The apparatus of claim 23 wherein the handle is a separate part snapped into the tray at opposing ends of the tray, the handle pivoting upwardly for grasping and downwardly for allowing better access to the tray.

* * * * *